US009581421B2

(12) United States Patent
Sitz

(10) Patent No.: US 9,581,421 B2
(45) Date of Patent: Feb. 28, 2017

(54) UNIVERSAL HOLDER FOR A CLIP OR MAGAZINE FOR A FIREARM

(71) Applicant: Justin C. Sitz, Bryan, TX (US)

(72) Inventor: Justin C. Sitz, Bryan, TX (US)

( * ) Notice: Subject to any disclaimer, the term of this patent is extended or adjusted under 35 U.S.C. 154(b) by 63 days.

(21) Appl. No.: 14/134,955

(22) Filed: Dec. 19, 2013

(65) Prior Publication Data

US 2014/0103083 A1 Apr. 17, 2014

Related U.S. Application Data

(63) Continuation-in-part of application No. 13/987,603, filed on Aug. 12, 2013, now Pat. No. 9,261,328, and a continuation-in-part of application No. 13/900,242, filed on May 22, 2013, now Pat. No. 9,182,205, and a continuation-in-part of application No. 13/066,269, filed on Apr. 11, 2011, now abandoned.

(51) Int. Cl.

| | |
|---|---|
| ***F41C 33/02*** | (2006.01) |
| ***F42B 39/02*** | (2006.01) |
| ***F41A 23/18*** | (2006.01) |
| ***F42B 39/08*** | (2006.01) |
| ***F42B 39/22*** | (2006.01) |

(52) U.S. Cl.

CPC ..... *F42B 39/02* (2013.01); *F41A 23/18* (2013.01); *F41C 33/0245* (2013.01); *F42B 39/08* (2013.01); *F42B 39/22* (2013.01)

(58) Field of Classification Search

CPC .. F41A 9/63; F42B 39/00; F42B 39/02; F42B 39/22

USPC ..... 224/239, 243, 255, 247, 248, 268, 272, 224/666, 904, 931

See application file for complete search history.

(56) References Cited

U.S. PATENT DOCUMENTS

| | | | |
|---|---|---|---|
| 1,166,781 | A | 1/1916 | Parrish |
| 1,768,177 | A | 6/1930 | Wanee |
| 2,401,174 | A | 5/1946 | McAuley |
| 2,758,762 | A | 8/1956 | Medley |
| 2,764,326 | A | 9/1956 | Stanton |
| 2,765,107 | A | 10/1956 | Browning |

(Continued)

OTHER PUBLICATIONS

Waggenspack, Adam J., "Non-Final Office Action dated Dec. 5, 2014", U.S. Appl. No. 13/066,269, The United States Patent and Trademark Office, Dec. 5, 2014.

(Continued)

*Primary Examiner* — Adam Waggenspack

(74) *Attorney, Agent, or Firm* — Lindauer Law, PLLC

(57) ABSTRACT

Holders usable to retain a clip, magazine, or other container for ammunition can include a body configured for attachment to a surface and an insertable member extending from the body, the insertable member being adapted for insertion into the interior of a container for ammunition. The insertable member can bias the container for ammunition against a portion of the body to create friction between the container and the body and prevent relative movement between the two objects. Alternatively or additionally, contact between the insertable member and the interior of the container, can create friction for preventing relative movement between the container for ammunition and the holder. The insertable element can be compressible to enable passage through an external opening in the container to facilitate removal or insertion.

22 Claims, 10 Drawing Sheets

(56) References Cited

U.S. PATENT DOCUMENTS

| | | | | |
|---|---|---|---|---|
| 2,951,622 | A | 9/1960 | Heim | |
| 3,353,728 | A | 11/1967 | Freed | |
| 3,642,184 | A | 2/1972 | Hendricks | |
| 3,796,358 | A | 3/1974 | Grubb | |
| 3,938,717 | A | 2/1976 | Theodore | |
| 4,022,361 | A | 5/1977 | Devlin | |
| 4,120,109 | A | 10/1978 | Musgrave | |
| 4,442,962 | A | 4/1984 | Musgrave | |
| 4,473,248 | A * | 9/1984 | Preradovich | A01B 1/18 294/50.8 |
| 4,483,089 | A | 11/1984 | Johnson | |
| 4,580,363 | A | 4/1986 | Rowe, Jr. | |
| 4,597,213 | A | 7/1986 | Musgrave | |
| 4,667,374 | A | 5/1987 | Bianchi | |
| 4,928,876 | A | 5/1990 | Marshall | |
| 5,081,709 | A | 1/1992 | Benyo et al. | |
| 5,129,562 | A | 7/1992 | Bianchi | |
| 5,167,355 | A | 12/1992 | Hill | |
| 5,322,297 | A | 6/1994 | Smith | |
| 5,358,160 | A | 10/1994 | Bianchi | |
| 5,472,317 | A | 12/1995 | Field et al. | |
| 5,584,423 | A | 12/1996 | Wang | |
| 5,611,471 | A | 3/1997 | French | |
| 5,622,297 | A | 4/1997 | Rogers et al. | |
| 5,624,064 | A * | 4/1997 | McGee, Jr. | 224/414 |
| 5,749,507 | A | 5/1998 | Wood | |
| 5,806,739 | A | 9/1998 | Wood | |
| 5,810,222 | A | 9/1998 | Shoemaker | |
| 5,855,305 | A | 1/1999 | Nichols | |
| 6,003,207 | A | 12/1999 | Homma | |
| 6,398,089 | B1 | 6/2002 | Har-Shen | |
| 6,626,339 | B2 * | 9/2003 | Gates | B62J 9/003 150/154 |
| 6,668,479 | B1 | 12/2003 | Obong | |
| 6,695,183 | B2 * | 2/2004 | Hancock | B60R 11/00 211/64 |
| 6,829,855 | B2 | 12/2004 | Seifert | |
| 7,314,152 | B1 | 1/2008 | Garrett | |
| 8,006,424 | B1 | 8/2011 | Ligard | |
| 8,533,876 | B2 | 9/2013 | Bonk | |
| 2009/0229292 | A1 | 9/2009 | Sweeney | |
| 2009/0321480 | A1 | 12/2009 | Kincaid et al. | |
| 2010/0264177 | A1 | 10/2010 | Clifton, Jr. | |
| 2012/0260554 | A1 | 10/2012 | Huffines | |

OTHER PUBLICATIONS

Waggenspack, Adam J., "Non-Final Office Action dated Jan. 27, 2015", U.S. Appl. No. 13/900,242, The United States Patent and Trademark Office, Jan. 27, 2015.

Waggenspack, Adam J., "Final Office Action dated May 6, 2015", U.S. Appl. No. 13/066,269, The United States Patent and Trademark Office, May 6, 2015.

Waggenspack, Adam J., "Notice of Allowance dated Jul. 8, 2015", U.S. Appl. No. 13/900,242, The United States Patent and Trademark Office, Jul. 8, 2015.

Young, Lee W., "Patent Cooperation Treaty International Search Report and Written Opinion dated Jun. 15, 2012", PCT Application No. PCT/US12/00153, Patent Cooperation Treaty, Jun. 15, 2012.

Waggenspack, "Final Office Action dated May 21, 2013", U.S. Appl. No. 13/066,269, The United States Patent and Trademark Office, May 21, 2013.

Waggenspack, "Non Final Office Action dated Jan. 4, 2013", U.S. Appl. No. 13/066,269, The United States Patent and Trademark Office, Jan. 4, 2013.

Waggenspack, Adam J., "Notice of Allowance dated Nov. 23, 2015", U.S. Appl. No. 13/987,603, The United States Patent and Trademark Office, Nov. 23, 2015.

Waggenspack, Adam J., "Non-final Office Action dated Jul. 28, 2015", U.S. Appl. No. 13/987,603, The United States Patent and Trademark Office, Jul. 28, 2015.

Waggenspack, Adam J., "Advisory Action, dated Aug. 21, 2015", U.S. Appl. No. 13/066,269, The United States Patent and Trademark Office, Aug. 21, 2015.

* cited by examiner

UNIVERSAL HOLDER FOR A CLIP OR MAGAZINE FOR A FIREARM

CROSS-REFERENCE TO RELATED APPLICATIONS

The present application is a continuation-in-part application, which claims priority to the co-pending U.S. application for patent having the application Ser. No. 13/900,242, filed May 22, 2013, the co-pending U.S. application for patent having the application Ser. No. 13/066,269, filed Apr. 11, 2011, and the co-pending U.S. application for patent having the application Ser. No. 13/987,603, filed Aug. 12, 2013. Each of the above-referenced applications is incorporated by reference herein in its entirety.

FIELD

Embodiments usable within the scope of the present disclosure relate, generally, to holders for retaining containers, and more specifically, to holders adapted to engage, secure, and/or otherwise retain clips, magazines, or similar containers used to hold ammunition for firearms.

BRIEF DESCRIPTION OF THE DRAWINGS

In the detailed description of various embodiments usable within the scope of the present disclosure, presented below, reference is made to the accompanying drawings, in which.

Figure 1A:
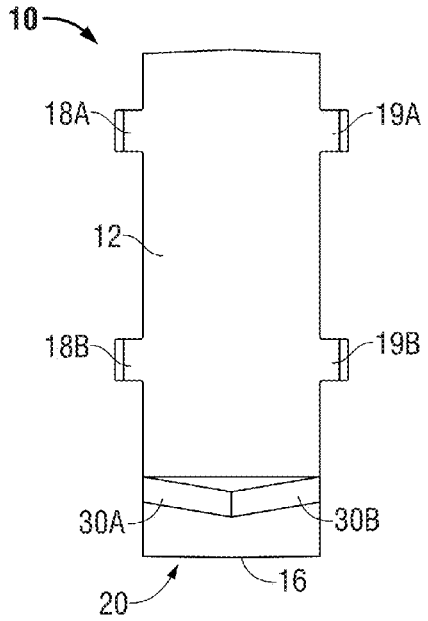
FIG. 1A depicts a front view of an embodiment of a holder usable within the scope of the present disclosure.
Figure 1B:
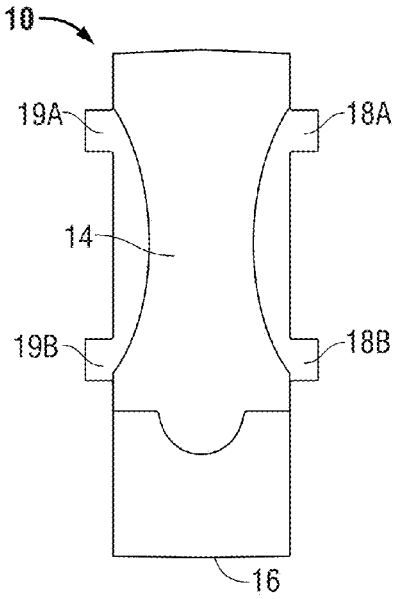
FIG. 1B depicts a rear view of the holder of FIG. 1A.
Figure 1C:
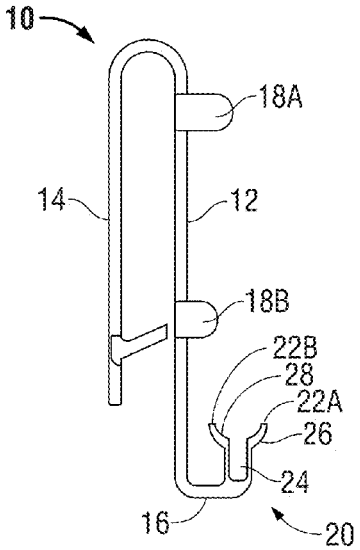
FIG. 1C depicts a side view of the holder of FIG. 1A.
Figure 1D:
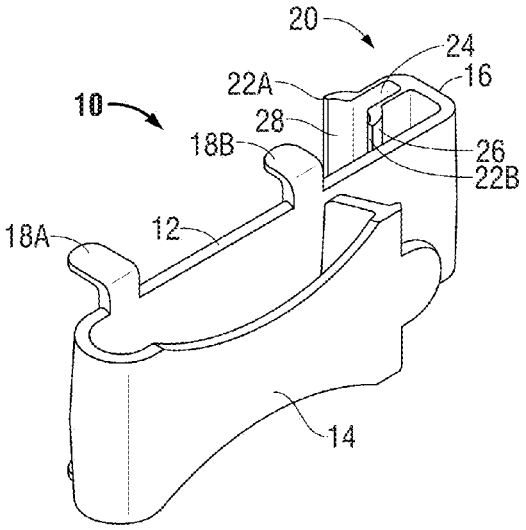
FIG. 1D depicts an isometric view of the holder of FIG. 1A.

One or more embodiments are described below with reference to the listed Figures.

DETAILED DESCRIPTION OF THE EMBODIMENTS

Before describing selected embodiments of the present invention in detail, it is to be understood that the present invention is not limited to the particular embodiments described herein. The disclosure and description herein is illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended illustrate and plainly disclose presently preferred embodiments of the invention to one of skill in the art, but are not intended to be manufacturing level drawings or renditions of final products and may include simplified conceptual views as desired for easier and quicker understanding or explanation of the invention. As well, the relative size and arrangement of the components may differ from that shown and still operate within the spirit of the invention as described throughout the present application.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

Embodiments usable within the scope of the present disclosure relate to holders usable to retain, secure, and/or engage containers for ammunition for firearms (e.g., clips, magazines, and/or similar containers). The terms "clip," "magazine," and "container for ammunition" may be used interchangeably herein; however, it should be understood that embodiments usable within the scope of the present disclosure can be used with any type of container or similar body configured for containing ammunition for a firearm of any type, independent of the form, features, or characteristics thereof.

When it is desirable for a user of a firearm to conveniently carry additional ammunition, e.g., in the form of a spare magazine or clip, conventional methods for doing so include carrying the container for ammunition loosely (e.g., in a pocket or bag), using some manner of strap or containment mechanism to attach the container to the exterior of a firearm (e.g., to or within the hilt or buttstock), or wearing a specialized "holster," sized and shaped to contain a specific type of clip or magazine. Because conventional methods either lack convenience (e.g., by failing to retain a container for ammunition in an easily accessible location), or require specialized components sized and shaped to interact with the external features of a clip or magazine, which can vary extensively depending on the manufacturer and type thereof, a need exists for a universal holder, able to engage, secure, and/or retain a wide variety of containers for ammunition independent of the exterior features thereof, by engaging the interior of a container for ammunition (e.g., a chamber of a magazine or clip normally occupied by a bullet, round, and/or cartridge), which will be generally identical among every clip and magazine designed to hold ammunition of the same or similar caliber. A holder that does not require physical structure to accommodate the external features of a container for ammunition can have a minimum of bulk, facilitating ease of manufacture and reducing cost, while also providing a minimal profile that is more readily concealable than conventional alternatives. Embodied holders that do not require physical structure to accommodate the external features of a container for ammunition can also generally be worn ambidextrously, on either side of a user's body, and can selectively be worn internal of or external to a user's belt and/or pants or other lower body garment.

Embodiments usable within the scope of the present disclosure can generally include holders having a body configured for attachment to a surface (e.g., using a clip for attachment to an article of clothing, or other features and/or fasteners suitable for mounting to the underside of a bar, table, or other item of furniture, or to the interior of a vehicle, including without limitation, adhesives, Velcro™ or similar hook-and-loop fasteners, brackets, clips, clamps, clasps, bolts, rivets, screws, nails, etc.). An insertable member can extend from the body. The insertable member can be sized for insertion into the interior of a container for ammunition (e.g., the portion of a clip or magazine normally occupied by ammunition).

For example, in an embodiment, the insertable member can include a compressible, curved member having two portions with a gap therebetween, such that the curved member can be compressed and expanded between a first dimension, sized for passage through an opening in the exterior of a container for ammunition, an a second, larger dimension (e.g., sufficiently large to contact the interior of the container and/or prevent exodus of the insertable member from the container). Use of an insertable member having a curved shape provides the insertable member with an exterior surface that can contact the interior of the container for ammunition, while the interior surface is shaped to accommodate the presence of ammunition within the interior (e.g., defining a space in the insertable member that can be occupied by a bullet/round, such that engagement between the holder and the container does not require removal of any ammunition to accommodate the holder).

In an embodiment, the body of the holder can include one or more protrusions extending therefrom, at an angle (e.g., perpendicular thereto or positioned at another non-parallel angle). Contact between the insertable member and the interior of the container for ammunition can bias the container against one or more of the protrusions to create friction therebetween. For example, the insertable member can have one or more angled loading surfaces thereon, that apply a biasing force to the container for ammunition (e.g., due to interactions between the angled loading surface and the loading faces of a clip or magazine). In an embodiment, the insertable member can include two opposed loading surfaces, to enable ambidextrous use of the holder, e.g., engagement and/or removal of a container for ammunition to and from the holder from either side, subsequently enabling wearing of the holder on either side of a user's body and/or use of either hand from either direction.

In an embodiment, the body of the holder can include a face and a support surface that extends from the face at a first angle, while the insertable member extends from the face at a second angle. Contact between the insertable member and the interior of the container for ammunition can bias the container against the face of the body, thereby creating friction therebetween.

In use, the insertable member can be inserted (e.g., longitudinally, along the axis of a round or chamber within the container for ammunition) into a space within the container, in a manner that may or may not require compression thereof. In an embodiment, contact between the insertable member and the interior of the container may be sufficient to frictionally retain the container for ammunition in place; however, additionally or alternatively, contact between the insertable member and the container for ammunition can bias the container against one or more portions of the body of the holder (e.g., protrusions therefrom, the face thereof, etc.), thereby frictionally securing the container against the body. While the container can be removed by longitudinally sliding the insertable member out from the interior of the container, in embodiments where a compressible insertable member is used, the container for ammunition can simply be pulled outward from the insertable member, thereby compressing the insertable member and enabling passage thereof out from the container for ammunition. In an embodiment, the container and/or the holder can be moved, bent, tilted, angled, etc. to reduce contact between the container and the holder prior to disengaging the container from the insertable member, thereby preventing friction between the container and holder body from hindering the removal process.

For example, in an embodiment one or more portions of the holder can be formed from a bendable material (e.g., plastic, rubber, or similar materials) that can be manually deformed but has a tendency to return to its original shape, to facilitate positioning of the insertable member in a manner suitable for insertion thereof into the interior of a clip or magazine. To facilitate subsequent disengagement of a clip or magazine from the holder, the bendable material can be flexed to reduce or eliminate contact between the clip or magazine and the body of the holder.

FIGS. 1A, 1B, 1C, and 1D depict, respectively, front, rear, side, and isometric views of an embodiment of a holder (10) for containers for ammunition (e.g., clips, magazines, etc.), usable within the scope of the present disclosure. The holder (10) is shown having a body that includes a face (12) (e.g., a generally flat plate), having a clip (14) or similar type of fastener extending therefrom, e.g., to secure the holder (10) to a user's belt, waistband, a strap of a bag or other garment, or another similar type of object. Various types of clips (14) and/or other types of fasteners can be used for securing and/or mounting the holder (10) to a user's clothing or any other surface, such as a wall, floor, ceiling, vehicle, article of furniture, etc., without departing from the scope of the present disclosure. Exemplary embodiments of usable clips are described in detail in U.S. application Ser. Nos. 13/900,242; 13/066,269; and 13/987,603, which have been incorporated by reference herein.

A support surface (16) is shown extending from an end of the face (12) at an angle relative thereto. For example, FIGS. 1A through 1D depict the support surface (16) extending generally perpendicular to the face (12), though other non-parallel angles could be used without departing from the scope of the present disclosure. The body is also shown having four protrusions (18A, 18B, 19A, 19B) extending outward from the face (12) at an angle. While the protrusions (18A, 18B, 19A, 19B) are shown extending generally perpendicular to the face (12), other non-parallel angles could be used without departing from the scope of the present disclosure. Additionally, while FIGS. 1A through 1D depict four protrusions extending from the face (12), of which two protrusions (18A, 18B) extend from a first side and two protrusions (19A, 19B) extend from an opposing side thereof, it should be understood that any number of protrusions extending from any portion of the body can be used, or in an embodiment, use of such protrusions could be omitted. Additionally, while FIGS. 1A through 1D depict two lower protrusions (18B, 19B) having a length less than that of the two upper protrusions (18A, 19A), protrusions having any dimensions relative to one another can be used without departing from the scope of the present disclosure.

Figure 5:
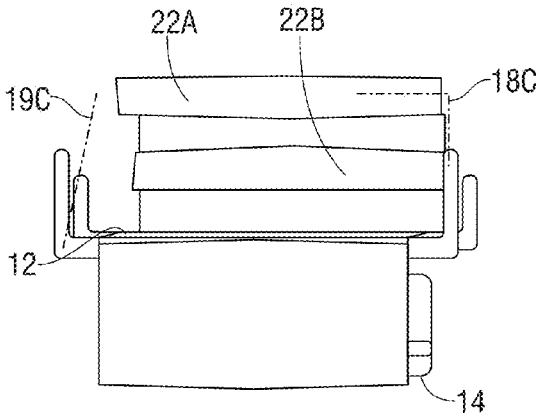
FIG. 5 is a diagrammatic top view, illustrating alternate embodiments of the holder of FIG. 1A.

For example, FIG. 5 depicts a diagrammatic top view of an embodiment of a holder, illustrating, on one side thereof, a possible position of an angled protrusion (19C). Use of an angled protrusion can increase frictional contact between a container for ammunition engaged with the holder, and can also serve to at least partially contact a front/outer surface of a container to facilitate retention thereof (e.g., by slightly enclosing the container for ammunition). Use of angled protrusions can also enable embodied holders to accommodate containers for ammunition having a large variety of widths (e.g., a container having a first width could contact the outermost portion of a set of protrusions, while a container having a larger width could cause one or more protrusions to flex outward and/or contact an inner portion of a set of protrusions). On the opposing side of the depicted diagram, a possible position of a bent and/or L-shaped protrusion (18C) is shown, which can serve to abut and/or retain a container for ammunition from two sides—the side and front/outer portion thereof, e.g., by at least partially enclosing the container for ammunition. Of note, FIG. 5 also depicts the first and second portions (22A, 22B) of the insertable member horizontally staggered and/or offset from one another, enabling the outermost edge of each portion (22A, 22B) to function as a stop when engaging a container for ammunition therewith (e.g., the outermost edge can contact the interior of a side of a magazine or other container).

Returning to FIGS. 1A through 1D, an insertable member (20) is shown extending from the support surface (16) at an angle relative thereto. FIGS. 1A through 1D show the insertable member (20) extending generally perpendicular to the support surface (16); however other non-parallel angles could be used without departing from the scope of the present disclosure. For example, in an embodiment, at least one of the angles between the face (12), support surface (16), and insertable member (20) could be acute, such that the insertable member (20) extends toward the face (12), thereby frictionally biasing a container for ammunition engaged with the insertable member (20) against the face (12). However, the insertable member (20) can extend perpendicular to and/or outward from the body of the holder (10) without departing from the scope of the present disclosure.

The insertable member (20) is shown as a compressible member, having a curved shape with an exterior surface (26) adapted to at least partially contact an interior of a container for ammunition when engaged therewith, and an interior surface (28) adapted to accommodate a round (e.g., a bullet or other type of ammunition) within the container, such that the round can occupy the space within the curved shape, enabling the holder (10) to be engaged with the container for ammunition without requiring removal of any of the ammunition therefrom. The depicted insertable member (20) includes a first portion (22A) and a second portion (22B), separated by a gap (24), such that the insertable member (20) can be compressed to a narrower dimension by applying a force against one or both of the portions (22A, 22B), toward the other portion, thereby narrowing the gap (24) as at least one of the portions (22A, 22B) moves closer to the other.

Figure 4:
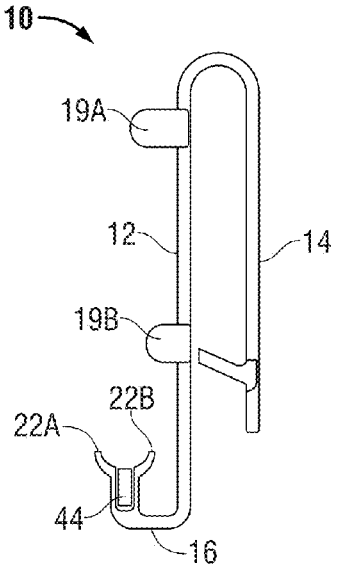
FIG. 4 depicts a side view of an alternate embodiment of the holder of FIG. 1C.

In an embodiment, the gap (24) can include a compressible material to facilitate the resiliency and/or spring-like tendency of the portions (22A, 22B) of the insertable member (20) to return to their original position. For example, FIG. 4 depicts a side view of an embodiment of a holder (10), having a compressible material (44), such as rubber, one or more polymers, plastics, composites, or any other material that is at least partially compressible, and usable to apply an outward force to the portions (22A, 22B) of the insertable member (20). It should be readily understood that while FIG. 4 depicts a compressible material (44) that substantially fills the gap (24), (shown in FIG. 1C), in various embodiments, the gap could be only partially filled with such materials, or alternatively, other compressible members could be used in place of the compressible material (44), such as a leaf spring, a coil spring, or other type of mechanical member. In a further embodiment, one or both of the portions (22A, 22B) of the insertable member (20) could be hinged and/or otherwise pivotably secured to the remainder of the holder to facilitate movability thereof (e.g., when engaging or disengaging a container for ammunition to or from the holder), while the spring or other type of compressible member and/or material can be used to urge the portions (22A, 22B) outward from one another. In an embodiment, the distance across the insertable member (20) can be variable (e.g., through use of adjustable springs or spacers, insertion of differing quantities of compressible material in the gap, use of hinged/movable/adjustable portions (22A, 22B), etc.), enabling a single insertable member (20) to be usable to engage multiple sizes (e.g., calibers) of containers for ammunition. In further embodiments, the insertable member (20) could be removable and/or replaceable, such that insertable members of varying sizes could be attached, as needed, to accommodate multiple sizes (e.g. calibers) of containers for ammunition.

Returning to FIGS. 1A through 1D, the front side of the insertable member (20) is shown having a first angled loading surface (30A) on a first side thereof, opposite a second angled loading surface (30B) having a substantially equal and opposite angled orientation relative to the body of the holder (10), providing the front of the insertable member (20) with a "V" shaped engagement area. In use, the angle of one of the loading surfaces (30A, 30B) can accommodate the loading faces of a clip/magazine or similar container for ammunition, while applying a biasing force against the container. For example, a loading surface (30A, 30B) can be non-parallel to a loading face or other surface of the container for ammunition that abuts the loading surface, such that a lateral force is applied to the container, urging the container against the protrusions (18A, 18B, 19A, 19B) along one side of the holder (10), creating friction between the container and the protrusions. Alternatively or additionally, contact between a bullet/round within the container for ammunition and a portion of the insertable member (20) can apply a lateral force against the container. The presence of two, generally identical loading surfaces (30A, 30B) enables a container for ammunition to be engaged with the insertable member (20) from either side thereof, thereby enabling ambidextrous wearing and/or use of the holder (10).

In addition to the biasing force applied to a container for ammunition by one or more of the loading surfaces (30A, 30B), or in the alternative thereto, contact between the insertable member (20) and the interior of a container for ammunition can serve to frictionally retain the container in engagement with the holder (10). Additionally or alternatively, contact between the insertable member (20) and the container for ammunition can bias the container against the face (12), the protrusions (18A, 18B, 19A, 19B), or any other portion of the holder (10), to frictionally retain the container in engagement with the holder (10).

Figure 2A:
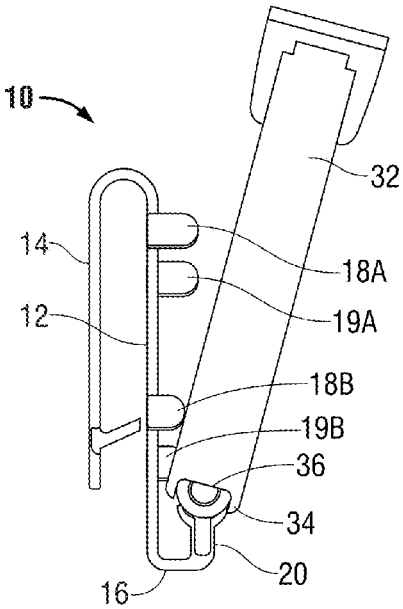
FIG. 2A depicts a side view of the holder of FIG. 1A, partially engaged with a container for ammunition.
Figure 2B:
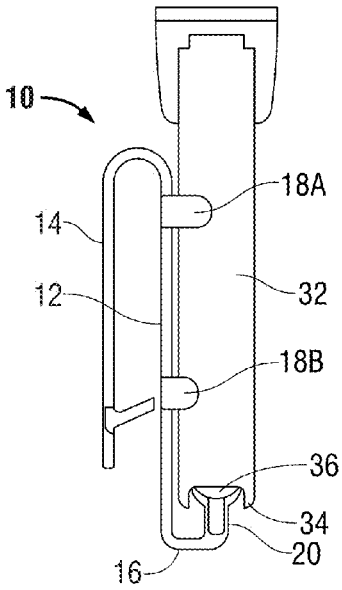
FIG. 2B depicts a side view of the holder of FIG. 2A fully engaged with the container for ammunition.
Figure 2C:
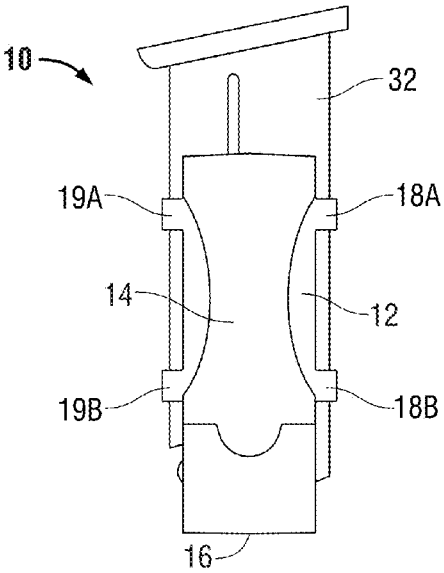
FIG. 2C depicts a rear view of the holder of FIG. 2B.
Figure 2D:
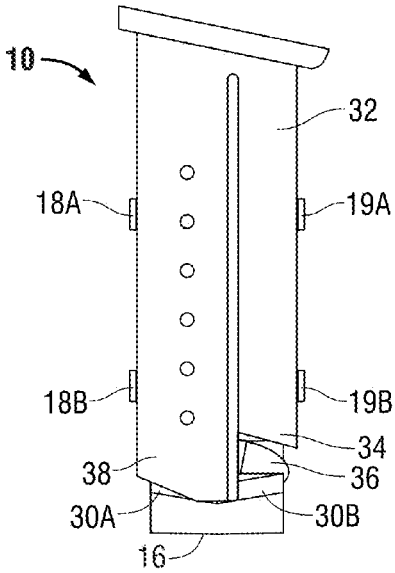
FIG. 2D depicts a front view of the holder of FIG. 2B.

FIGS. 2A through 2D depict a container (32) for ammunition (e.g., a clip for use with a pistol) engaged with the holder shown in FIGS. 1A through 1D. Specifically, FIG. 2A depicts a side view of the container and holder in a partially engaged and/or partially disengaged position, while FIG. 2B depicts a side view of the container and holder in a fully engaged position. FIGS. 2C and 2D depict rear and front views, respectively, of the holder and container shown in FIG. 2B. It should be understood that while FIGS. 2A through 2D depict a clip intended for use with a pistol, holders usable with other types of containers for ammunition usable with any type of firearm (e.g., rifles, machine guns, etc.) could be used without departing from the scope of the present disclosure.

The holder is shown having a face (12) with the support surface (16) and four protrusions (18A, 18B, 19A, 19B) extending therefrom (e.g., generally perpendicular thereto), and the above-described insertable member (20) extending from the support surface (16). The angled loading surfaces (30A, 30B) are shown at the front of the insertable member (20). The container (32) for ammunition is shown having a generally rectangular body with an external opening (34) proximate to an end thereof, through which a round (36) or other type of ammunition is visible.

FIG. 2A depicts the container (32) disposed relative to the holder (10) in a position immediately following engagement between the insertable member (20) and the container (32), or a position immediately preceding disengagement therebetween. Specifically, the container (32) is shown angled and/or tilted relative to the face (12) of the holder (10), such that friction between the holder (10) and the container (32) is limited to any friction generated via contact between the insertable member (20) and the interior of the container (32). FIGS. 2B through 2D depict the container (32) proximate to and/or in contact with the face (12) and/or one or more of the protrusions (18A, 18B, 19A, 19B) of the holder (10).

To engage a container (32) for ammunition with the holder, the insertable member (20) can be passed through the external opening (34) of the container (32), into the interior thereof. While in various embodiments, it can be possible to compress the insertable member (20) to a dimension suitable to pass through an opening in the lower end of the container (32), in various embodiments, it can be possible to longitudinally slide the insertable member (20) into a side portion of the opening (34). In an embodiment, longitudinal entry of the insertable member (20) into the opening (34) may require minimal compression of the insertable member (20), or no compression thereof. As the insertable member (20) is inserted into the opening (34), the load face (38) of the container (32) can slide and/or otherwise be guided along the angled loading surface (30A) of the insertable member (20), due to the angled loading surface (30A) being generally complementary in shape and/or angle to the load face (38) of the container (32). It should be understood that while FIG. 2D depicts the load face (38) of the container (32) proximate to and/or contacting the first angled loading surface (30A), the presence of two generally identical, opposing loading surfaces (30A, 30B) can enable the container (32) to be engaged with the insertable member (20) from either direction, such that the load face (38) could be positioned proximate to the second loading surface (30B). The space defined above the interior surface (28) (shown in FIGS. 1C and 1D) of the insertable member (20) accommodates the round (36) within the interior of the container (32), such that no ammunition need be removed from the container (32) or significantly displaced to accommodate engagement between the container (32) and the holder (10).

After engagement between the container for ammunition (32) and the insertable member (20), one or both of the container (32) and holder (10) can be moved, pivoted, rotated, etc., such that the container (32) is positioned generally proximate to and/or contacting the face (12) and/or one or more of the protrusions (18A, 18B, 19A, 19B), as shown in FIGS. 2B through 2D. Engagement between the container for ammunition (32) and the holder (10) can limit relative movement between the container (32) and holder (10) in various ways.

For example, contact between the insertable member (20) and the interior of the container (32) can generate friction between the insertable member (20) and the container (32), usable to limit movement of the container (32) relative to the holder (10). Additionally, the inability of the insertable member (20) to freely pass through the opening (34) without application of an external force (e.g., a pulling or manual force by a user) can serve to physically retain the holder (10) in engagement with the container (32).

Additionally or alternatively, contact between the insertable member (20) and the container (32) can bias the container toward the body of the holder (10), e.g., against the face (12) thereof, creating friction between the container (32) and the face (12) to limit movement of the container (32) relative to the holder (10). Contact between the face (12) and the container (32) can also serve to physically prevent angling, tipping, pivoting, and/or rotation of the container (32) relative to the insertable member (20) (e.g., about the longitudinal axis thereof).

Further, additionally or alternatively, contact between the insertable member (20) (e.g., one or both loading surfaces (30A, 30B) thereof) and the container (32) (e.g., the load face (38) thereof), can bias the container (32) in a lateral direction, e.g., against one set of protrusions (18A, 18B or 19A, 19B), thereby creating friction between the protrusions and the container (32). Contact between one or more of the protrusions (18A, 18B, 19A, 19B) and the container (32) can also serve to prevent angling, tipping, pivoting, etc. of the container (32) in a horizontal/lateral direction relative to the holder (10), e.g., due to contact between the loading surfaces (30A, 30B) and the container (32).

Figure 3B:
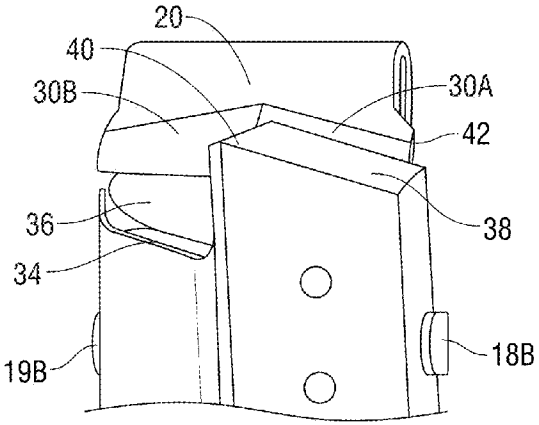
FIG. 3B depicts a front view of the portion of the holder of FIG. 3A.
Figure 3C:
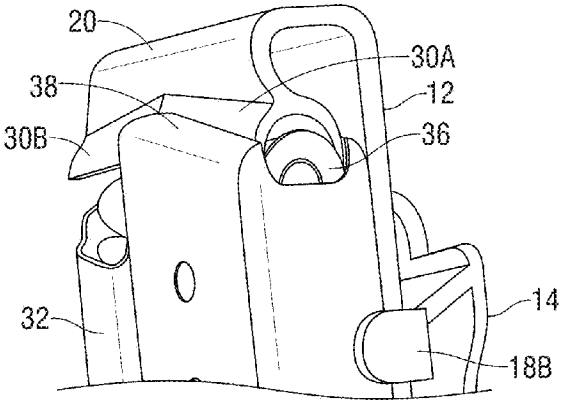
FIG. 3C depicts an isometric view of the portion of the holder of FIG. 3A.
Figure 3A:
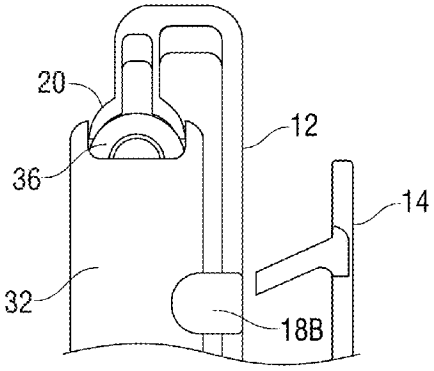
FIG. 3A depicts a side view of a portion of the holder of FIG. 2B.

FIGS. 3A through 3C depict side, front, and isometric views, respectively, of the container (32) for ammunition and holder (10) of FIGS. 2B through 2D, depicting the engagement between the insertable member (20) and the container (32) in greater detail. Specifically, the insertable member (20) is shown positioned within the interior of the container (32), with the exterior surface of the insertable member (20) in contact therewith, while the space defined along the interior surface (28) of the insertable member (20) accommodates the position of the round (36).

The insertable member (20) can be engaged with the container (32) by placing an inner end (40) of the load face (38) of the container (32) over an outer end (42) of the insertable member (20), then sliding and/or otherwise laterally moving one of the container (32) and/or the holder (10) relative to the other (e.g., sliding the container (32) for ammunition inward to more fully position the insertable member (20) through the opening (34) and within the interior of the container (32)), until the container (32) reaches the position shown in FIG. 3B. Movement of the load face (38) toward the depicted position can be guided by the angled loading surface (30A).

To remove the container (32) for ammunition from the holder (10), the container (32) can be angled/rotated/pivoted away from the body of the holder, e.g., to reduce or eliminate friction between the face (12) and/or protrusions (18A, 18B, 19A, 19B) and the container (32), similar to the position depicted in FIG. 2A. A manual force applied to the container (32) in a direction away from the insertable member (20) can cause compression of the insertable member (20) (e.g., due to the force applied against the exterior surface of the depicted curved portions), such that the insertable member (20) passes through the opening (34) to disengage the holder (10) from the container (32) for ammunition. While the above-described method for removing a container for ammunition from the holder (10) is efficient and effective, in various embodiments, it can be possible to laterally move the container (32) relative to the holder (10), e.g., longitudinally along the axis of the insertable member (20), in the opposite direction of that described in the insertion/engagement process above.

Figure 6:
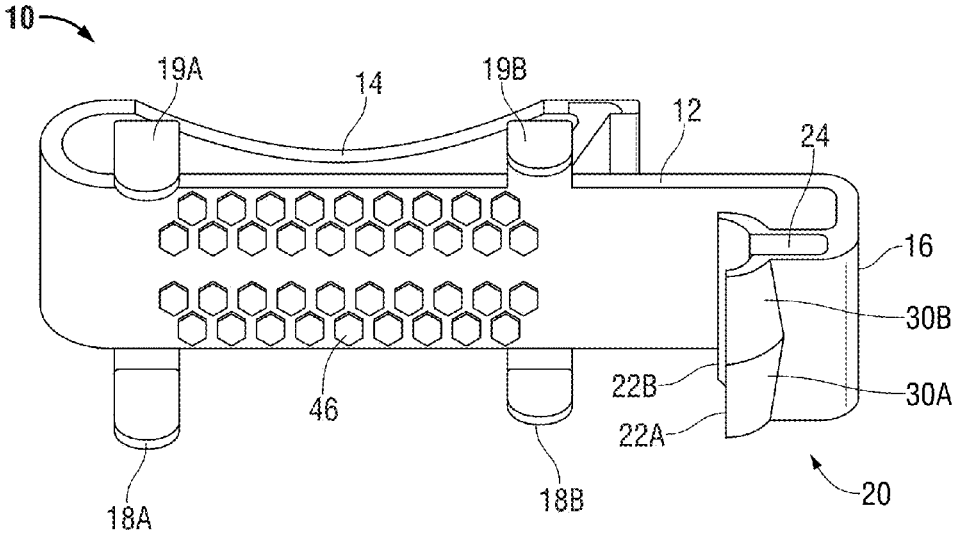
FIG. 6 depicts a front perspective view of an alternate embodiment of the holder of FIG. 1A.

FIG. 6 depicts a front perspective view of an embodiment of a holder (10) for retaining a container (32) for ammunition having a face (12) with a clip (14), support surface (16), and four protrusions (18A, 18B, 19A, 19B) extending therefrom, and an insertable member (20) with two portions (22A, 22B) separated by a gap (24) extending from the support surface (16). Two angled loading surfaces (30A, 30B) are shown formed on the first portion (22A) of the insertable member (20). Each of the above-mentioned features, and exemplary variations thereto, are described above in detail, with reference to FIGS. 1A through 5. The embodiment shown in FIG. 6 includes a frictional surface (46) disposed on the face (12). Use of a frictional surface can enable contact between an engaged container (32) for ammunition and the face (12) to generate an enhanced degree of friction that can function to retain the container (32) in association with the holder (10). Usable frictional surfaces can include high-frictional materials, such as rubber, and can additionally or alternatively include use of textured surfaces (e.g., having protrusions extending from the face (12) and/or grooves formed in the face (12)). In an embodiment, the frictional surface (46) can include a compressible member/material that applies an outward force against the engaged container (32) for ammunition to further increase friction between the container (32) and the holder (10). In an embodiment, the frictional surface (46) can include overmolding formed over the face (12) and/or other portions of the holder (10). In an embodiment, overmolding can be provided over a core of steel or a similar durable member to provide a holder having enhanced strength. Compressible members and overmolding are described in detail in U.S. application Ser. Nos. 13/900,242; 13/066,269; and 13/987,603, which have been incorporated by reference herein.

In an embodiment, the face (12) and/or other portions of the holder (10) could include a ferromagnetic member, usable to attract and/or otherwise bias a container (32) for ammunition against one or more portions of the holder (10) generating friction therebetween. Use of magnets in this capacity is described in detail in one or more of U.S. application Ser. Nos. 13/900,242; 13/066,269; and 13/987,603, which have been incorporated by reference herein.

It should be noted that while FIGS. 1A through 6 depict various embodiments of holders as a single-piece structure (e.g., a molded unit), one or more portions of the holder (10) could be manufactured separately and attached to one another without departing from the scope of the present disclosure. Further, in an embodiment, one or more portions of the holder (10) could be movably and/or adjustably secured to one another, e.g., to enable positioning of an engaged container (32) for ammunition at an angle relative to the clip (14) for enabling carrying of the container (32) for ammunition at a desired position/angle. U.S. application Ser. Nos. 13/900,242; 13/066,269; and 13/987,603, which have been incorporated by reference herein, describe various methods by which the clip and/or insertable member of a holder can be movably and/or adjustably positioned relative to the body thereof. It should further be noted that any of the characteristics described above with regard to various embodiments of holders usable within the scope of the present disclosure can be used independently or in combination with any other features described herein.

Figure 7:
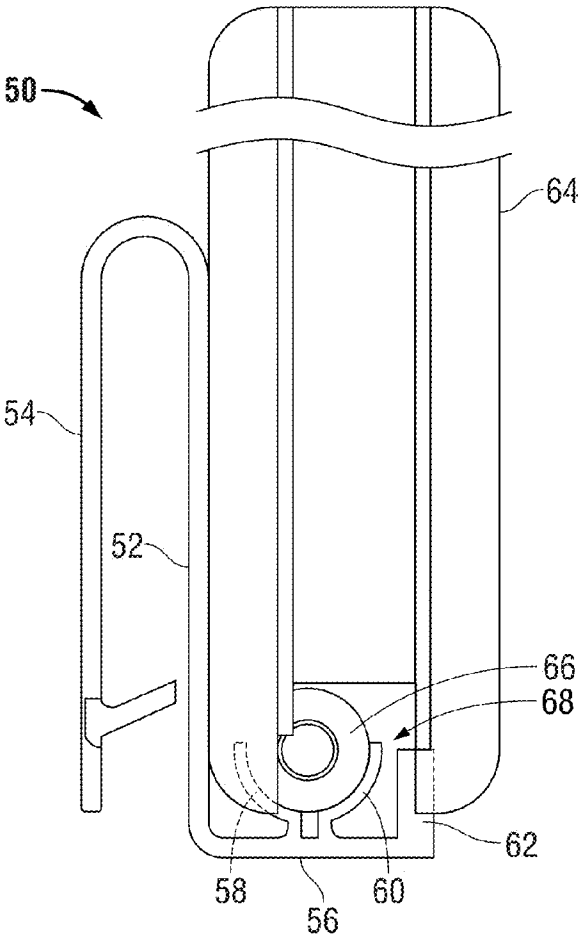
FIG. 7 depicts a diagram illustrating an embodiment of a holder usable within the scope of the present disclosure.

While FIG. 1A through 6 depict embodiments of holders used in conjunction with a clip and/or magazine for use with a pistol (e.g., a single-stack magazine), it should be understood that embodiments usable within the scope of the present disclosure can be used with double-stack magazines (e.g., magazines for rifles and similar firearms) and/or other types of containers for ammunition. For example, FIG. 7 depicts a diagram illustrating an embodiment of a holder (50) having a face (52) with a clip (54) extending therefrom (e.g., for attachment to a user's belt, other article of clothing, or other surface). A support surface (56) extending from the face (52) includes an insertable member having first and second curved portions (58, 60) with a gap therebetween, similar to the embodied holders described previously.

The depicted holder (50) is shown engaged with a double-stack magazine (64), having a round (66) visible therein. Due to the width and/or configuration of the depicted magazine (64), an additional space (68) exists adjacent to the round (66). FIG. 7 depicts a protrusion (62) extending outward from the support surface (56) to enter the additional space (68). During use, the curved shape of the portions (58, 60) of the insertable member can accommodate the presence of the round (66), while abutting a first side of the interior of the magazine (64), while the protrusion (62) can abut and/or otherwise resist lateral movement of the magazine (64), e.g., through contact with the opposing side of the interior.

Figure 8:
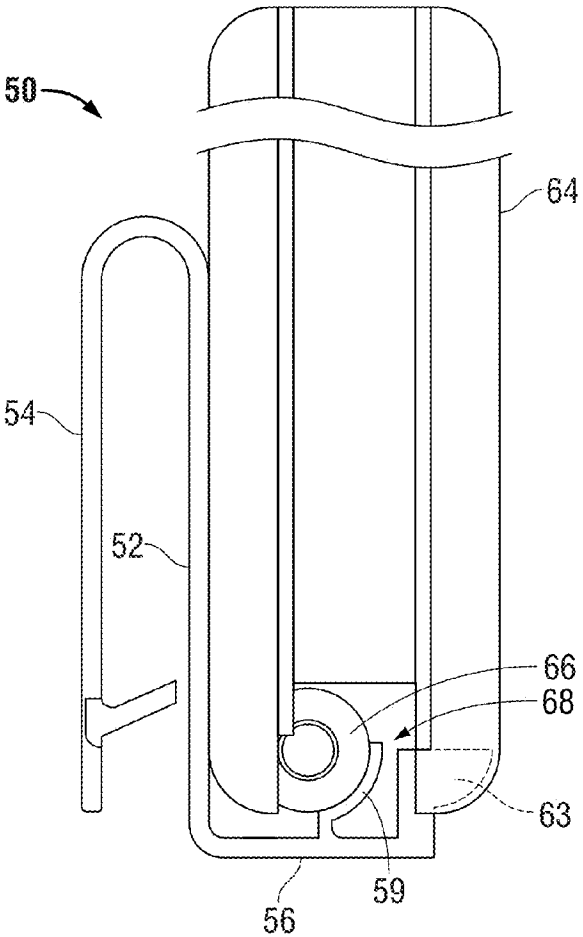
FIG. 8 depicts a diagram illustrating an alternate embodiment of the holder of FIG. 7.

FIG. 8 depicts an alternate embodiment of the holder (50). Specifically, the depicted embodiment includes the face (52), clip (54), and support surface (56), as described previously. However, in the depicted embodiment, the insertable member is depicted having only a single curved portion (59), the shape of which accommodates the position of the round (66) in the magazine. To accommodate the absence of a portion of the insertable member abutting the innermost side of the interior of the magazine (64), the depicted protrusion (63) extending into the additional space (68) is shown having a lateral extension adapted to abut, contact, and/or otherwise limit movement of the magazine (64) relative to the holder (50).

In various embodiments of the holders described herein, the depicted clips can be removable, e.g., to allow for the attachment of alternate mounting means and/or to allow for easy attachment of holders and/or associated magazines/clips to a user's belt. For example, when carrying a spare magazine for a rifle, a user would typically wear an embodied holder on the outside of a belt or other garment due to the size of the magazine. To facilitate attachment and detachment of a magazine to the user's belt and/or clothing, a removable clip could be used, such that the clip can remain generally continuously attached to a user's belt or clothing while the remainder of the holder and an engaged magazine can be attached and detached therefrom.

In various embodiments, a holder could include a latch, protrusion, lock, or similar element to engage the release slot of an engaged magazine. In such embodiments, the insertable member of the holder can generally retain and stabilize an engaged magazine and/or other container for ammunition, while the latch prevents unintentional disengagement of the container for ammunition from the holder.

Figure 9A:
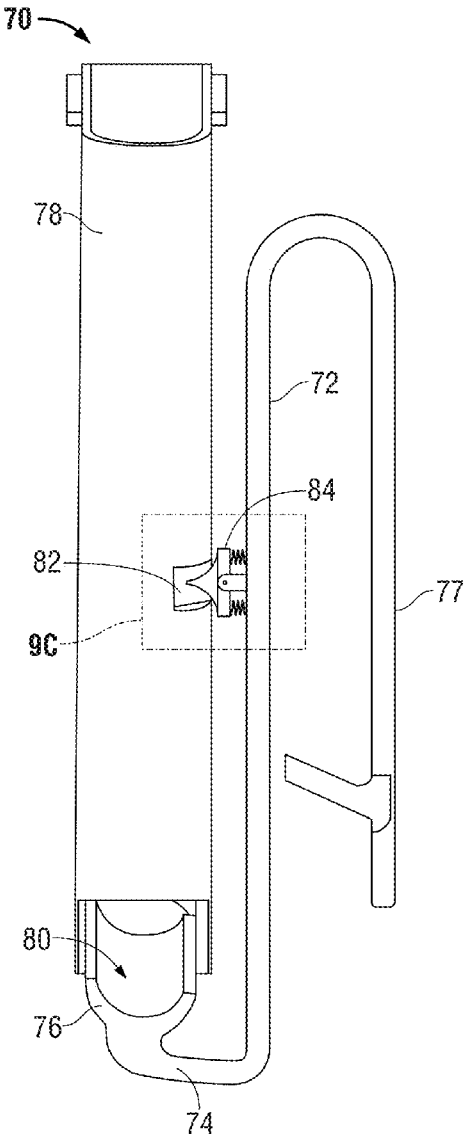
FIG. 9A depicts a side view of an embodiment of a holder usable within the scope of the present disclosure.

For example, FIG. 9A depicts a side view of an embodiment of a holder (70) usable within the scope of the present disclosure, the holder (70) having a first body (72) (e.g., a face, plate, etc.) with a support surface (74) extending therefrom at an angle, an insertable member (76), having a curved and/or "U"-shaped construction, similar to that described with regard to other embodiments herein extending from the support surface (74), and a clip (77) usable to attach the holder (70) to an article of clothing or other object. The holder (70) is shown engaged with a magazine (78) via insertion of the insertable member (76) into a lower opening (80) thereof.

In the depicted embodiment, the holder (70) includes a spring-biased latch assembly (84) extending from the face/plate (72) toward the magazine (78) to engage the magazine (78) by inserting a portion of the assembly (84) into the latch slot (82) of the magazine (78).

Figure 9B:
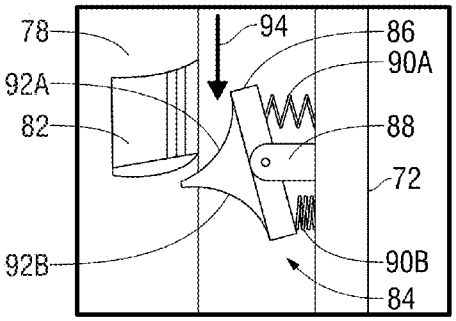
FIG. 9B depicts a side view of a portion of the holder of FIG. 9A.
Figure 9C:
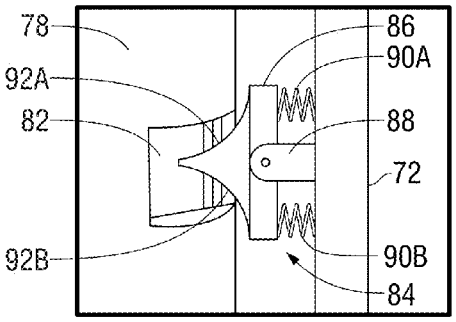
FIG. 9C depicts a side view of the portion of the holder of FIG. 9B.
Figure 9D:
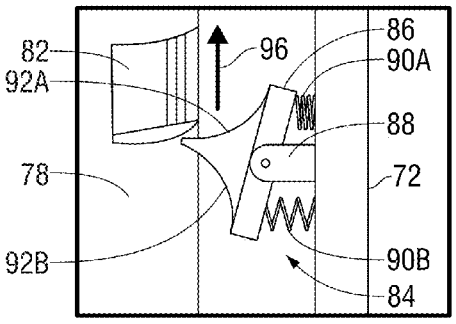
FIG. 9D depicts a side view of the portion of the holder of FIG. 9B.

FIGS. 9B, 9C, and 9D depict a side, detail view showing the spring-biased latch assembly (84) in greater detail. The depicted assembly (84) is shown having a movable plate (86), pivotably attached to a support (88) extending from the face (72) of the holder, the movable plate (86) having a protruding member with two sides (92A, 92B) extending therefrom, away from the face (72) of the holder. While FIGS. 9A through 9D depict a protruding member with two sides (92A, 92B) that have a curved shape, it should be understood that in various embodiments, a latch assembly could have a two or more protruding members without departing from the scope of the present disclosure. An upper spring (90A), and a lower spring (90B) operate in tandem to bias the movable plate (86) to a position generally parallel to the face (72) and perpendicular to the depicted support (88), as shown in FIG. 9C.

FIG. 9B depicts engagement of a magazine (78) with the holder, during which the magazine (78) moves in the direction indicated by the depicted arrow (94) relative to the holder. Contact between the magazine (78) and the protruding member (92A) pivots the movable plate (86) in a downward direction, compressing the lower spring (90B) while allowing the upper spring (90A) to expand, placing the assembly (84) in the position shown in FIG. 9A. Once the protruding member is aligned with the slot (82) in the magazine (78), the upper and lower springs (90A, 90B) are permitted to return the plate (86) and protruding member to the position shown in FIG. 9C. Contact between the protruding member sides (92A, 92B) and the portions of the magazine (78) that define the edges of the slot (82) can thereby limit movement of the magazine (78) that would disengage the magazine (78) from the holder. A manual force sufficient to compress the upper spring (90A) would generally be usable to pivot the plate (86) and disengage the magazine (78) from the holder.

For example, FIG. 9C depicts disengagement of the magazine (78), during which the magazine (78) moves in the direction indicated by the depicted arrow (96 (shown in FIG. 9D)) relative to the holder. Contact between the lower edge of the slot (82) and the protruding member (92B) compresses the upper spring (90A), allowing the lower spring (90B) to expand and pivoting the plate (86) toward the position shown in FIG. 9C, such that the assembly (84) does not significantly interfere with further movement of the magazine (78).

While embodiments usable within the scope of the present disclosure are wearable by a user within the user's belt and/or waistband, e.g., such that a container for ammunition is positioned against the user's body and beneath a user's garments to reduce visibility, in various embodiments, holders could be worn outside of a user's garments and/or attached to other types of surfaces external to a user's body. In such embodiments, an enclosure can be used to limit movement of an engaged container for ammunition away from the holder.

Figure 10A:
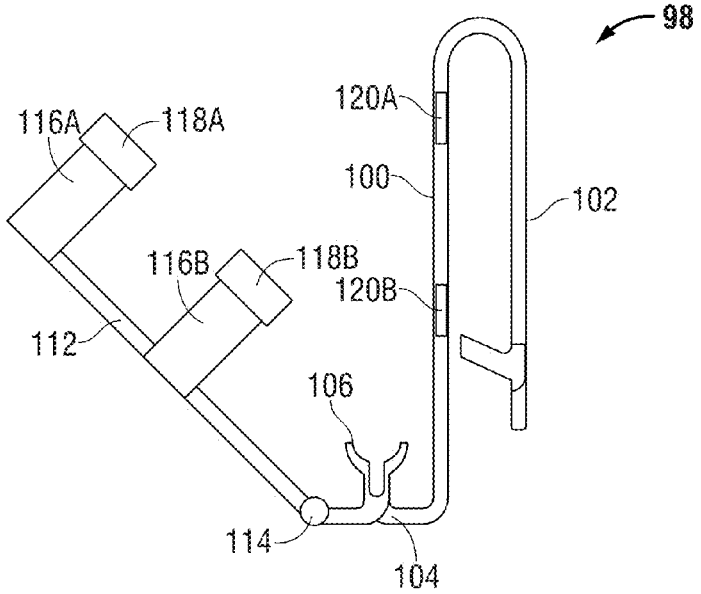
FIG. 10A depicts a side view of an embodiment of a holder usable within the scope of the present disclosure.
Figure 10B:
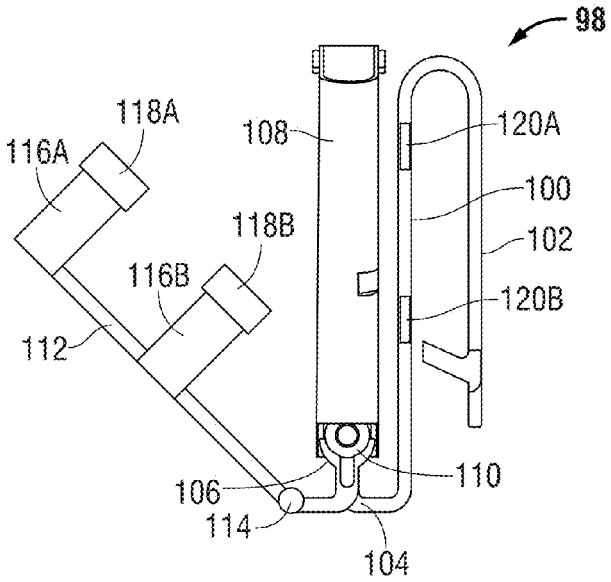
FIG. 10B depicts a side view of the holder of FIG. 10A engaged with a container for ammunition, in an open position.
Figure 10C:
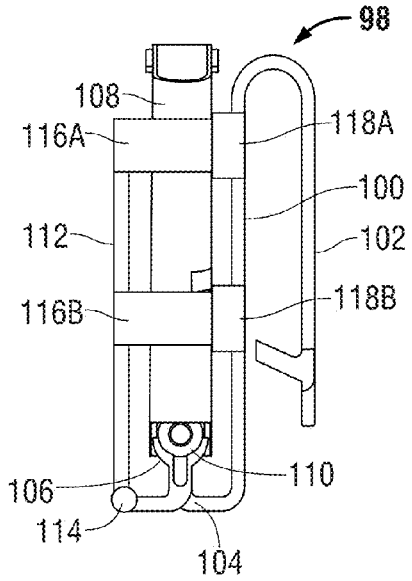
FIG. 10C depicts a side view of the holder of FIG. 10A engaged with a container for ammunition, in a closed position.

For example, FIGS. 10A, 10B, and 10C depict an embodiment of a holder (98), having a face (100), clip (102), support surface (104), and insertable member (106), similar to those described with reference to other embodiments, above. The depicted embodiment also includes an enclosure (112), movably (e.g., pivotably) attached to the support surface (104) at a hinge (114). The enclosure (112) is shown having a primary body from which two extensions (116A, 116B) are shown extending therefrom (e.g., perpendicular thereto). Identical and/or similar extensions can be provided on the opposing side of the enclosure (112). When pivoted from an open position, shown in FIGS. 10A and 10B to a closed position, shown in FIG. 10C, latches (118A, 118B) positioned at the ends of each extension (116A, 116B) can engage latch receivers (120A, 120B) (e.g., protrusions, recessions, etc.) positioned along the face (100), such that the primary body of the enclosure (112) limits movement of an engaged container away from the face (100), while the extensions (116A, 116B) limit lateral movement of the container relative to the holder (98). FIGS. 10B and 10C depict a magazine (108), having a round (110) therein, engaged with the insertable member (106) of the holder (98). FIG. 10B depicts the holder (98) in an open position (e.g., having the enclosure (112) pivoted away from the face (100)), while FIG. 10C depicts the holder (98) in a closed position, with the enclosure (112) and extensions (116A, 116B) proximate to and enclosing the magazine (108). While in various embodiments, use of an enclosure structure may not be necessary, an enclosure can provide a physical barrier that limits movement of an engaged container for ammunition in the manner that a user's body would limit such movement when a holder is worn inside of a user's garments (e.g., such that an engaged container for ammunition contacts a user's body).

While many of the embodiments described above are described with reference toward use with a magazine usable with a pistol, it should be understood that embodiments usable within the scope of the present disclosure can be used with any type of container for ammunition, intended for use with any type of firearm, including rifles, machine guns, and/or other types of weaponry.

Figure 11A:
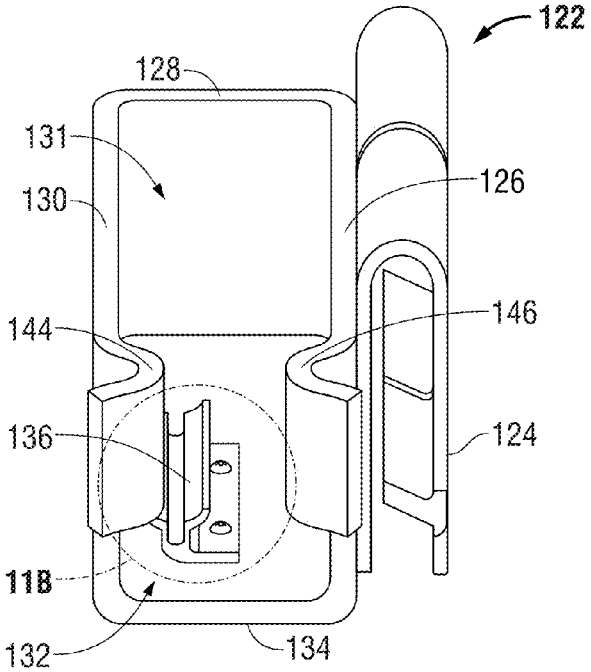
FIG. 11A depicts a perspective view of a holder usable within the scope of the present disclosure.
Figure 11B:
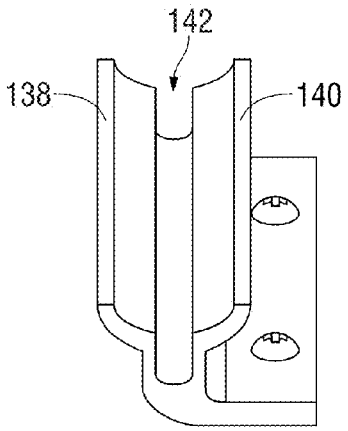
FIG. 11B depicts a perspective view of a portion of the holder of FIG. 11A.
Figure 11C:
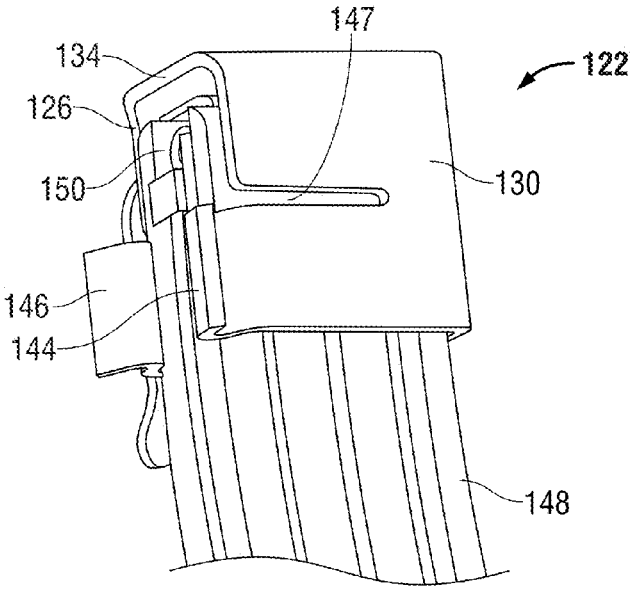
FIG. 11C depicts the holder of FIG. 11A engaged with a container for ammunition.

For example, FIGS. 11A, 11B, and 11C depict an embodiment of a holder (122) usable with a container (148) for ammunition (e.g., a clip/magazine) intended for use with an assault rifle. The depicted holder (122) includes a clip (124) for engagement with an article of clothing or other object, and an enclosure that includes a rear face (126), a side face (128), a front face (130), and a lower support surface (134), which define an open top (131) and an open side (132) of the enclosure. An insertable member (136), similar to those described above with reference to other embodiments, and further described below, is shown extending from the lower support surface (134). For example, FIG. 11B depicts the insertable member (136) having a front portion (138) and a rear portion (140), with a gap (142) therebetween, that provide the insertable member (136) with an upper curved (e.g., concave) surface for accommodating the position of ammunition within the container (148). Two crimped extensions (144, 146) extend from the front and rear faces (126, 130), having a portion of reduced diameter usable to limit lateral movement of an engaged container for ammunition relative to the holder (122). One or more slots and/or gaps (147) formed between the extensions (144, 146) and the remainder of the holder (122) can enable bending/flexing of the extensions (144, 146), such that movement of the container (148) laterally (e.g., to engage the feed lips thereof, proximate to the opening (150) in the container (148), to the insertable member (136)) can displace the extensions (144, 146) in an outward direction. Once the container (148) has been engaged and the body thereof has been moved past the extensions (144, 146), the extensions (144, 146) can return to a narrow position such that contact between the extensions (144, 146) and the container (148) can limit lateral movement of the container (148) relative to the holder (122), as shown in FIG. 11C.

While FIGS. 11A through 11C depict an insertable member (136) generally similar to that shown with reference to other embodiments, it should be understood that the depicted insertable member (136) is a single exemplary embodiment and that other configurations of insertable members can be used without departing from the scope of the present disclosure.

Figure 12A:
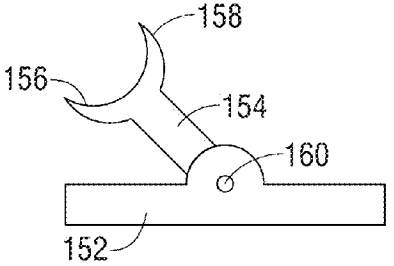
FIG. 12A depicts an embodiment of an insertable member of a holder usable within the scope of the present disclosure in a first position.
Figure 12B:
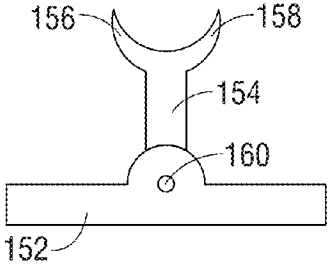
FIG. 12B depicts an embodiment of an insertable member of a holder usable within the scope of the present disclosure in a second position.
Figure 12C:
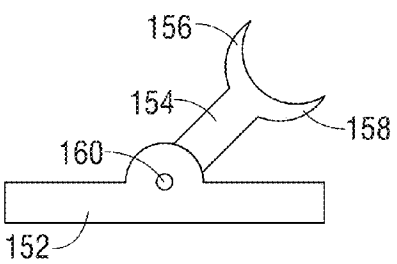
FIG. 12C depicts an embodiment of an insertable member of a holder usable within the scope of the present disclosure in a third position.

FIGS. 12A through 12G depict embodiments of insertable members usable within the scope of the present disclosure. While the body of the accompanying holder has been omitted from FIGS. 12A through 12G for brevity and clarity, it should be understood that any of the depicted insertable members can be used with any manner of holder described herein. For example, FIGS. 12A, 12B, and 12C depict an embodiment of a movable insertable member, having a body (154) movably engaged with a support surface (152) via a hinge and/or pivot point (160). The insertable member is shown having first and second prongs (156, 158) that define a curved surface for accommodating the position of ammunition within a container. The embodiment depicted in FIGS. 12A through 12C can be used, for example, in magazines for rifles, other types of "double-stack" containers, and/or containers where the lateral position of a round of ammunition may vary. For example, FIGS. 12A through 12C each illustrate the insertable member oriented in a different position relative to the support surface (152).

Figure 12D:
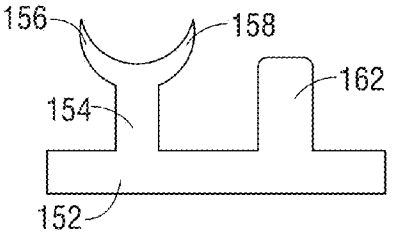
FIG. 12D depicts an embodiment of an insertable member of a holder usable within the scope of the present disclosure.
Figure 12E:
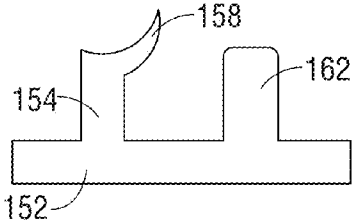
FIG. 12E depicts an embodiment of an insertable member of a holder usable within the scope of the present disclosure.

FIG. 12D depicts an insertable member having a body (154) with prongs (156, 158) fixedly engaged with and/or unitary with a support surface (152). A secondary contact member (162) is shown extending from the support surface (152), spaced a distance from the body (154). In use, for example, with wide containers for ammunition, such as those used with rifles and other larger arms, the curved surface defined by the prongs (156, 158) can accommodate a round of ammunition located at a first lateral position within a container for ammunition, while the secondary contact member (162) can limit movement of the container, e.g., in a lateral direction, through contact between the secondary contact member (162) and the interior of the container. FIG. 12E depicts a similar configuration, with the insertable member having a single prong (158).

Figure 12F:
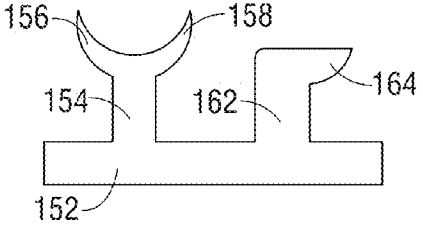
FIG. 12F depicts an embodiment of an insertable member of a holder usable within the scope of the present disclosure.
Figure 12G:
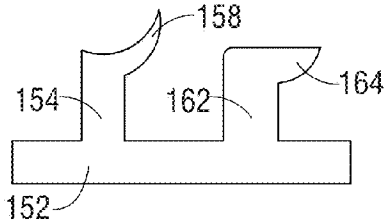
FIG. 12G depicts an embodiment of an insertable member of a holder usable within the scope of the present disclosure.

FIG. 12F depicts an insertable member having a body (154) with prongs (156, 158) fixedly engaged with and/or unitary with a support surface (152), a secondary contact member (162) extending from the support surface (152) a distance from the body (154), and an extension (164) protruding from the secondary contact member (162). The secondary contact member (162) and extension (164) can be positioned such that when a round of ammunition occupies the curved defined by the prongs (156, 158), the extension (164) can extend proximate to and/or into contact with the opposing side of the container for ammunition (e.g., above the lip of the opening therein). FIG. 12G depicts a similar configuration, with the insertable member having a single prong (158).

Figure 13A:
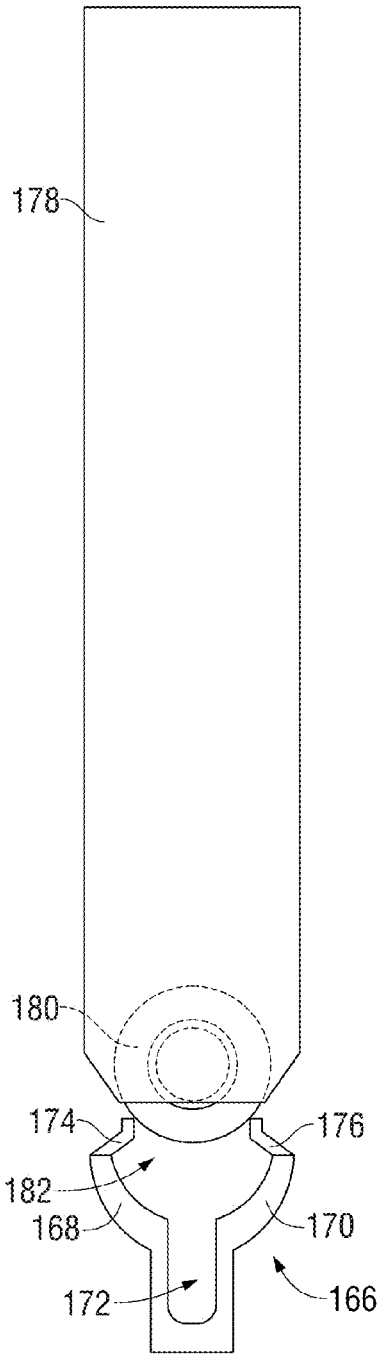
FIG. 13A depicts a diagrammatic side view of an embodiment of an insertable member usable within the scope of the present disclosure.
Figure 13B:
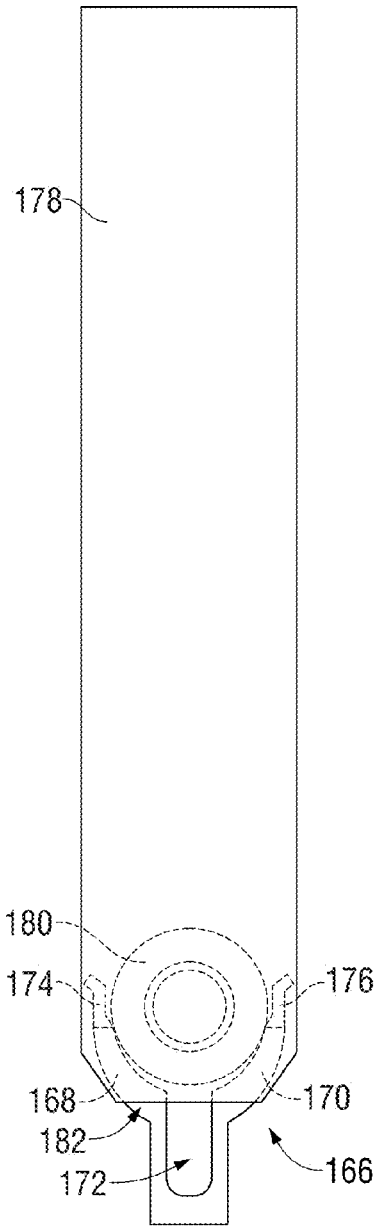
FIG. 13B depicts a diagrammatic side view of the insertable member of FIG. 13A, engaged with a container for ammunition.

FIGS. 13A and 13B depict diagrammatic side views of an embodiment of an insertable member (166) usable within the scope of the present disclosure. While the body of the accompanying holder has been omitted from FIGS. 13A and 13B for brevity and clarity, it should be understood that the depicted insertable member can be used with any manner of holder described herein. The depicted insertable member (166) can be used to accommodate vertical movement of a magazine (178) or other container for ammunition, as contrasted to longitudinal engagement (e.g., using relative lateral movement) between a container for ammunition and a holder, described above with regard to various embodiments.

The insertable member (166) is shown having a first portion (168) and a second portion (170), having a generally curved shape, with a gap (172) therebetween, such that the curved shape of the member (166) can accommodate the presence of a round (180) within the magazine (178). The gap (172) can enable vertical movement of the magazine (178) (e.g., movement in a direction outward from the insertable member (166)) to disengage the magazine (178) from the insertable member (166), e.g., by compressing the portions (168, 170) toward one another (narrowing the width of the gap (172)), such that the insertable member can pass through the lower opening (182) in the magazine (178).

In the depicted embodiment, the first portion (168) terminates at a first movable tip (174), while the second portion (170) terminates at a second movable tip (176). The tips (174, 176) can be hinged and/or formed from a flexible and/or resilient material, spring-biased, and/or otherwise urged toward a retracted position shown in FIG. 13A, such that the tips (174, 176) can pass into the opening (182) of the magazine (178) when the magazine (178) and/or the insertable member (166) is moved vertically to pass the insertable member (166) through the opening. Insertion of the insertable member (166) into the magazine (178) in this manner can also compress the portions (166, 168), narrowing the gap (172) therebetween.

After engagement between the magazine (178) and the insertable member (166) (e.g., after the insertable member (166) has passed through the opening (182)), the tips (174, 176) can expand to the position shown in FIG. 13B, e.g., due to contact between the tips (174, 176) and the round/ammunition therein (180). Contact between the insertable member (166) and the magazine (178) and/or contact between the magazine (178) and other portions of a holder (not shown) associated with the insertable member (166) can thereby stabilize the magazine (178) against unintentional movement (e.g., movement that would disengage the magazine (178) from the insertable member (166)). When it is desired to disengage the magazine (178) from the insertable member (166), a manual force can be applied in a vertical direction (e.g., away from the insertable member (166)), which can cause the lips of the opening (182) to contact and apply a force against the outer surface of the portions (168, 170), thereby compressing the portions (168, 170) and narrowing the width of the gap (172). Contact between the lips of the opening (182) and the tips (174, 176) and/or a biasing force can cause retraction of the tips (174, 176) toward the position shown in FIG. 13A.

Thus, embodiments described herein are thereby usable as holders for containers for ammunition, that can be "universal", e.g., usable to secure multiple types of clips, magazines, and/or similar containers for ammunition, independent of the exterior features thereof, thereby enabling a reduction in bulk, cost, materials, and manufacturing time, while facilitating concealment and wearing of the holder in a variety of orientations. The secure engagement of a container for ammunition with an embodied holder can be enhanced through the creation of friction between the container for ammunition and a portion of the holder.

While various embodiments usable within the scope of the present disclosure have been described with emphasis, it should be understood that within the scope of the appended claims, the present invention can be practiced other than as specifically described herein.

What is claimed is:

1. A holder comprising:

a body;

an insertable member spaced from the body, the insertable member comprising a first curved portion and a second curved portion that define a semi-circular shape having an open end wherein one or more of the first curved portion or the second curved portion is movable to change a width of a gap between the first curved portion and the second curved portion; and an adjustable member within the gap, the adjustable member configured to apply a force to at least one of the first curved portion or the second curved portion to bias the at least one of the first curved portion or the second curved portion away from the other of the first curved portion or the second curved portion.

2. The holder of claim 1, wherein the insertable member further includes a longitudinal axis, a rear side facing the body, and a front side opposite the rear side, the front side including an angled edge extending non-parallel to the longitudinal axis.

3. The holder of claim 2, wherein the body further includes at least one protrusion extending from the body toward the insertable member and the angled edge is configured to provide a force to an object engaged with the insertable member, the force having a component parallel to the longitudinal axis, to bias the object against the at least one protrusion to create friction between the object and the at least one protrusion.

4. The holder of claim 1, wherein the body further includes at least one protrusion extending from the body toward the insertable member, the body having a planar shape, and the at least one protrusion extends from an edge of the planar shape.

5. The holder of claim 1, wherein the first curved portion and the second curved portion each comprise a first end and a second end farther from the body than the first end, and the gap is positioned between the first end of the first curved portion and the first end of the second curved portion.

6. The holder of claim 1, wherein the adjustable member is configured to continuously apply the force to the at least one of the first curved portion or the second curved portion.

7. A holder for retaining a container for ammunition, the holder comprising:

a body configured for attachment to a surface, the body including a front face, a rear face, and at least one protrusion extending from the front face; and an insertable member extending from the body, the insertable member including a first side facing the body, a second side opposite the first side, and an angled loading surface on the second side, wherein the insertable member is adapted for insertion into an interior of the container for ammunition to bias the container for ammunition against the at least one protrusion using contact between the angled loading surface and the container for ammunition to create friction between the container for ammunition and the body for preventing relative movement between the container for ammunition and the holder.

8. The holder of claim 7, wherein the at least one protrusion extends from the body at a perpendicular angle.

9. The holder of claim 7, wherein the body includes an edge between the front face and the rear face and the at least one protrusion is positioned at the edge.

10. The holder of claim 7, wherein the angled loading surface is positioned on a first portion of the second side of the insertable member and is positioned at a first angle relative to an axis of the body, and wherein the insertable member further comprises a second angled loading surface disposed on a second portion of the second side at a second angle opposite the first angle for enabling ambidextrous use of the holder.

11. The holder of claim 7, wherein the body comprises a support surface extending from the front face at a first angle, wherein the insertable member extends from the support surface at a second angle, and wherein contact between the insertable member and the interior is configured to bias the container for ammunition against the body to create friction between the container for ammunition and the body.

12. The holder of claim 7, wherein the insertable member comprises a compressible element.

13. The holder of claim 12, wherein the compressible element is compressible and expandable between a first dimension adapted for passage through an opening in an exterior of the container for ammunition and a second dimension larger than the first dimension and adapted for contacting the interior of the container for ammunition.

14. The holder of claim 12, wherein the compressible element comprises a curved member having an exterior surface adapted for contacting the interior of the container for ammunition, and an interior surface shaped to accommodate ammunition within the interior of the container for ammunition.

15. The holder of claim 14, wherein the curved member comprises a first portion, a second portion, and a gap between the first portion and the second portion, and wherein compression of the curved member narrows a width of the gap.

16. A holder for retaining a container for ammunition, the holder comprising:

a body configured for attachment to a surface;

at least one protrusion extending from the body;

an insertable member extending from the body, wherein the insertable member is adapted for insertion into an interior of the container for ammunition to create friction between the container for ammunition and the insertable member for preventing relative movement between the container for ammunition and the holder, the insertable member including a first side facing the body and a second side opposite the first side; and an angled loading surface positioned on the second side of the insertable member, the angled loading surface configured to apply a force parallel to a plane of the body to the container for ammunition and bias the container for ammunition against the at least one protrusion to create friction between the container for ammunition and the at least one protrusion.

17. The holder of claim 16, wherein the insertable member comprises a compressible element that is compressible and expandable between a first dimension adapted for passage through an opening in an exterior of the container for ammunition and a second dimension larger than the first dimension and adapted for contacting the interior of the container for ammunition.

18. The holder of claim 16, wherein the insertable member comprises a curved member having an exterior surface adapted for contacting the interior of the container for ammunition, and an interior surface shaped to accommodate ammunition within the interior of the container for ammunition.

19. The holder of claim 18, wherein the curved member comprises a first portion, a second portion, and a gap between the first portion and the second portion, and wherein compression of the curved member narrows a width of the gap.

20. The holder of claim 16, wherein the at least one protrusion extends from the body at an angle of less than or equal to ninety degrees.

21. The holder of claim 20, wherein the body includes a first edge, a second edge opposite the first edge, and a face extending between the first edge and the second edge, the at least one protrusion extends from a first point on the first edge of the body opposite a second point on the second edge of the body, and at least a portion of the face between the first point and the second point is not occupied by the at least one protrusion.

22. The holder of claim 16, wherein the insertable member includes a first portion and a second portion separated by a space, the space having an adjustable member therein, the adjustable member applying a force to at least one of the first portion or the second portion to bias the at least one of the first portion or the second portion away from the other of the first portion or the second portion.

* * * * *